US008197138B2

(12) United States Patent
Turvey

(10) Patent No.: US 8,197,138 B2
(45) Date of Patent: Jun. 12, 2012

(54) EVACUABLE CONTAINER AND EVACUATION STRIP THEREFOR

(75) Inventor: Robert R. Turvey, Sanford, MI (US)

(73) Assignee: S.C. Johnson & Son, Inc., Racine, WI (US)

( * ) Notice: Subject to any disclaimer, the term of this patent is extended or adjusted under 35 U.S.C. 154(b) by 945 days.

(21) Appl. No.: 12/190,445

(22) Filed: Aug. 12, 2008

(65) Prior Publication Data

US 2010/0040310 A1 Feb. 18, 2010

(51) Int. Cl.
*B65D 33/01* (2006.01)

(52) U.S. Cl. ..... 383/103; 383/44; 383/101; 53/405; 53/434

(58) Field of Classification Search ..... 383/103, 383/44, 211, 100, 101, 45, 105, 109; 206/829, 206/579, 524.8, 543; 53/405, 84, 95, 510
See application file for complete search history.

(56) References Cited

U.S. PATENT DOCUMENTS

| | | | | |
|---|---|---|---|---|
| 3,207,420 | A | | 9/1965 | Navarrete-Kindelan |
| 3,311,517 | A | | 3/1967 | Keslar et al. |
| 3,494,820 | A | * | 2/1970 | Shewmake ..... 428/63 |
| 4,134,535 | A | * | 1/1979 | Barthels et al. ..... 383/102 |
| 4,741,789 | A | | 5/1988 | Zieke et al. |
| 4,755,248 | A | | 7/1988 | Geiger et al. |
| 4,927,474 | A | | 5/1990 | Pawloski |
| 5,012,561 | A | | 5/1991 | Porchia et al. |
| 5,070,584 | A | | 12/1991 | Dais et al. |
| RE34,929 | E | | 5/1995 | Kristen |
| 5,478,228 | A | | 12/1995 | Dais et al. |
| 5,492,705 | A | | 2/1996 | Porchia et al. |
| 5,554,093 | A | | 9/1996 | Porchia et al. |
| 5,584,409 | A | * | 12/1996 | Chemberlen ..... 220/89.1 |
| 5,618,111 | A | | 4/1997 | Porchia et al. |
| 5,655,273 | A | | 8/1997 | Tomic et al. |
| 5,689,866 | A | | 11/1997 | Kasai et al. |
| 6,021,557 | A | | 2/2000 | Dais et al. |
| 6,039,182 | A | * | 3/2000 | Light ..... 206/524.8 |
| 6,185,796 | B1 | | 2/2001 | Ausnit |
| 6,954,969 | B1 | | 10/2005 | Sprehe |
| 7,022,058 | B2 | | 4/2006 | Lee |
| 7,041,249 | B2 | | 5/2006 | Wright et al. |
| 7,087,130 | B2 | | 8/2006 | Wu et al. |
| 7,137,736 | B2 | | 11/2006 | Pawloski et al. |
| 7,138,025 | B2 | | 11/2006 | Wu et al. |
| 7,290,660 | B2 | | 11/2007 | Tilman et al. |
| 7,305,742 | B2 | | 12/2007 | Anderson |

(Continued)

*Primary Examiner* — Nathan J Newhouse
*Assistant Examiner* — Matthew Theis

(57) ABSTRACT

An evacuable container includes a first side wall having an interior surface and an exterior surface. The first side wall includes an aperture between the interior surface and the exterior surface. A second side wall has an interior surface and an exterior surface. The second side wall is connected to the first sidewall such that the interior surfaces of the first and second side walls form an interior of the container. A sheet has a first surface and a second surface. The first surface faces the exterior surface of the first side wall. The sheet is sealingly attached to the exterior surface of the first side wall so as to form a flow chamber between the first side wall and the sheet. The sheet includes (i) a plurality of flow channels disposed on the first surface, and (ii) an aperture between the first surface and the second surface. A check valve is disposed in fluid communication with the aperture in the sheet. An evacuation path can be formed from the interior of the container to an exterior of the container through the aperture in the first side wall, the flow chamber, the aperture in the sheet, and the check valve.

12 Claims, 13 Drawing Sheets

U.S. PATENT DOCUMENTS

| | | | | |
|---|---|---|---|---|
| 7,410,298 | B2 | 8/2008 | Pawloski | |
| 7,527,585 | B2 | 5/2009 | Anzini et al. | |
| 7,726,880 | B2 | 6/2010 | Zimmerman et al. | |
| 7,784,160 | B2 | 8/2010 | Dais et al. | |
| 7,837,387 | B2 | 11/2010 | Newrones et al. | |
| 7,874,731 | B2 | 1/2011 | Turvey et al. | |
| 7,886,412 | B2 | 2/2011 | Dais et al. | |
| 7,887,238 | B2 | 2/2011 | Turvey et al. | |
| 7,946,766 | B2 | 5/2011 | Dais et al. | |
| 7,967,509 | B2 | 6/2011 | Turvey et al. | |
| 2004/0050745 | A1 | 3/2004 | Lee | |
| 2005/0161465 | A1* | 7/2005 | Miller et al. | 222/1 |
| 2005/0238263 | A1 | 10/2005 | Ping | |
| 2006/0048483 | A1* | 3/2006 | Tilman et al. | 53/434 |
| 2006/0076058 | A1* | 4/2006 | Rypstra | 137/246 |
| 2006/0093242 | A1 | 5/2006 | Anzini et al. | |
| 2006/0193540 | A1 | 8/2006 | Borchardt | |
| 2006/0243386 | A1 | 11/2006 | Wu et al. | |
| 2006/0280388 | A1 | 12/2006 | Zimmerman et al. | |
| 2006/0280389 | A1 | 12/2006 | Zimmerman et al. | |
| 2007/0092167 | A1 | 4/2007 | Tilman et al. | |
| 2007/0154118 | A1 | 7/2007 | Tilman et al. | |
| 2007/0172157 | A1 | 7/2007 | Buchman | |
| 2008/0308177 | A1 | 12/2008 | Thuot et al. | |
| 2009/0175747 | A1 | 7/2009 | LeBoeuf et al. | |
| 2009/0324141 | A1 | 12/2009 | Dais et al. | |

* cited by examiner

EVACUABLE CONTAINER AND EVACUATION STRIP THEREFOR

CROSS REFERENCE TO RELATED APPLICATIONS

Not applicable.

REFERENCE REGARDING FEDERALLY SPONSORED RESEARCH OR DEVELOPMENT

Not applicable

SEQUENTIAL LISTING

Not applicable

FIELD OF THE INVENTION

The present disclosure generally relates to evacuable containers and devices useful for evacuating gases, including air, from evacuable containers.

BACKGROUND OF THE INVENTION

Vacuum evacuation of a container may be used to preserve freshness of food or other perishables within an interior of the container. Vacuum evacuation is typically achieved by applying a source of vacuum to the container. However, the container may become deformed by ambient pressure when evacuated, and deformation of the container may be especially problematic for containers that have flexible sidewalls. Interior surfaces of the flexible sidewalls may be forced into contact with one another, and may form seals therebetween that isolate a portion of the interior of the container from the source of the vacuum.

A pouch for vacuum packaging items has a first panel and a second panel that define an interior volume and an opening. Air evacuation channels are embossed onto inner surfaces of one or both of the first and second panels. The pouch has a divider panel disposed between the first and second panels to form distinct interior sub-volumes on either side of the divider panel. The distinct sub-volumes may be evacuated individually and allow the pouch to separately hold two items and keep the items separated. The divider panel may also have one or both sides thereof embossed with evacuation channels.

A flexible storage bag has first and second sidewalls defining an internal volume that can be accessed from an open edge. First and second interlocking closure strips are attached across the open edge to internal surfaces of the first and second sidewalls. A one-way valve element is attached to the first sidewall and includes a base layer having an aperture communicating with a hole in the first sidewall. A top layer is adhered to the base layer by two parallel strips of adhesive on opposite sides of the base layer such that the top layer covers the aperture in the base layer. The valve element is made of flexible thermoplastic film and is located proximate to a corner formed by a first side edge and the open edge. In addition, a viscous material, such as oil, grease, or a lubricant, is disposed between the base and the top layers, in order to prevent air from reentering the bag. When a vacuum is applied to the valve element or the bag is forcibly compressed, air passes through the hole in the first sidewall and the aperture in the base layer, thereby partially displacing the top layer from the base layer. The air passes to the environment along a channel formed by the adhesive strips. Another similar flexible storage bag has a plurality of protruding, elongated ridges extending from an inner surface of one of the sidewalls. At least one of the ridges includes a plurality of notches formed therein to provide a plurality of ridge segments for the flow of air.

A vacuum packaging bag has a resealable inner seal, such as a peel seal, that separates an internal volume of the bag into a storage section and a closure section. A resealable closure mechanism, such as a pair of opposing interlocking zipper profiles, is disposed in the closure section and a check valve is disposed through a side wall of the bag. A strip of textured material is disposed opposite to the check valve to provide a communication passage for the removal of liquids and gases through the valve. A vacuum system engages the check valve to evacuate the pouch.

Addition of flow channels to interior surfaces of a pouch may typically add complexity and cost to the manufacture of the pouch, and may restrict the utility of a production line to the manufacture of pouches that include flow channels.

SUMMARY OF THE DISCLOSURE

In one aspect of the present disclosure, an evacuable container comprises a first sidewall that defines an interior of the container and an opening. A flow channel chamber comprises first and second chamber walls. Flow channels are disposed on at least one of the first and second chamber walls. One of the first and second chamber walls is sealingly attached along an entire periphery thereof to the first sidewall. At least one interior aperture is disposed through the first or second chamber wall and is in fluid communication with the interior of the container. At least one exterior aperture is disposed through the first or second chamber wall and is in fluid communication with an exterior of the container. A check valve is disposed in fluid communication with the at least one exterior aperture and the flow channel chamber to allow resealable evacuation of the container through the flow channel chamber and the at least one interior aperture.

In another aspect of the present disclosure, an evacuation chamber strip comprises a sheet of material that has an interior side and an exterior side, and includes a first aperture disposed therethrough and flow channels disposed on the interior side thereof. The sheet of material is adapted to be sealingly attached along an entire periphery thereof to a container to define a flow channel chamber between the sheet of material and the container. A check valve provides a gastight seal between the flow channel chamber and the exterior side of the sheet of material.

In a further aspect of the present disclosure, an evacuable container comprises a first sidewall that defines an interior of the container and a mouth. A gastight resealable closure mechanism or a gastight removable lid is disposed across the mouth. A flow channel chamber comprises first and second chamber walls. Flow channels are disposed on at least one of the first and second chamber walls. One of the first and second chamber walls is sealingly attached along an entire periphery thereof to one of the first and second sidewalls. At least one interior aperture is disposed through the first or second chamber wall and is in fluid communication with the interior of the container. At least one exterior aperture is disposed through the first or second chamber wall and is in fluid communication with an exterior of the container. A check valve is disposed in fluid communication with the at least one exterior aperture and the flow channel chamber to allow resealable evacuation of the container through the flow channel chamber and the at least one interior aperture.

BRIEF DESCRIPTION OF THE DRAWINGS

Other aspects and advantages of the present disclosure will become apparent upon consideration of the following detailed description, wherein similar structures have similar reference numbers.

DETAILED DESCRIPTION

The present disclosure is directed to evacuable containers and devices for facilitating the evacuation thereof. A container may include, for example, a sealable plastic container, a storage pouch with a valve, a can, a bottle, a hermetically sealable volume, a hard-walled container with a gastight removable lid with a valve associated with the removable lid and/or a hard sidewall of the hard-walled container, and the like, and/or other containers suitable for vacuum packaging. While specific embodiments are discussed herein, it is understood that the present disclosure is to be considered only as an exemplification of the principles of the disclosure. The present disclosure is not intended to limit the disclosure to the embodiments illustrated.

Figure 1:
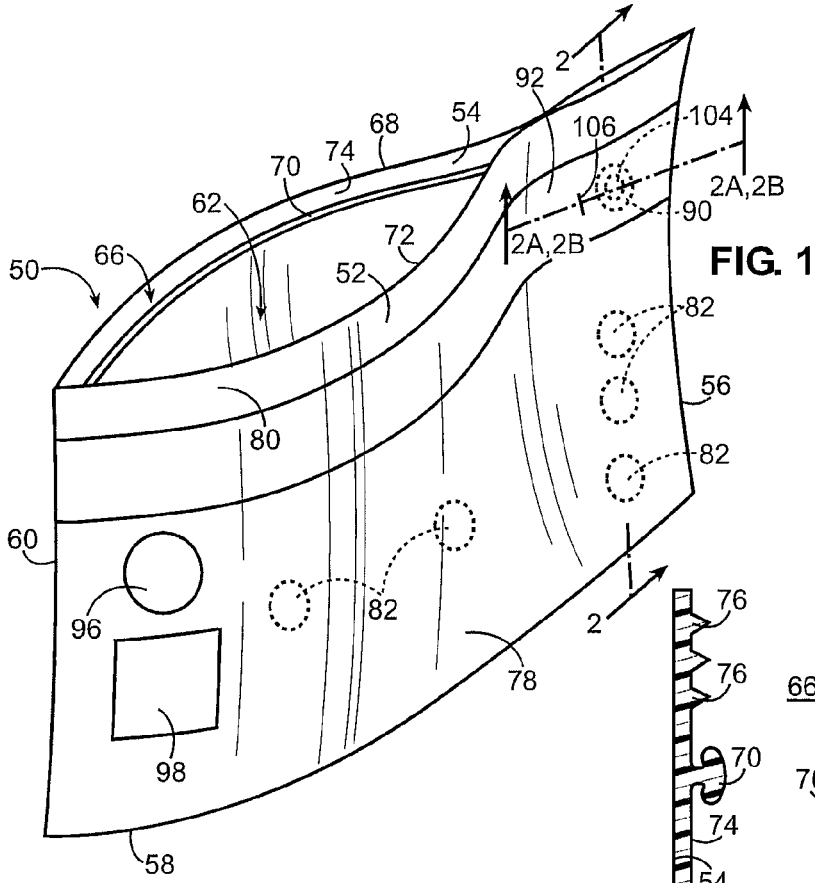
FIG. 1 is an isometric view of an embodiment of an evacuable container.

FIG. 1 illustrates an embodiment of a container, for example, an evacuable pouch 50 having a first sidewall 52 and a second sidewall 54 that are connected by, for example, folding, heat sealing, and/or an adhesive, along three peripheral edges 56, 58, 60 to define an interior space 62 between the first and second sidewalls 52, 54, an exterior space 64, and a mouth or opening 66 along a top edge 68 where the first and second sidewalls 52, 54 are not connected, so as to allow access to the interior space 62 from the exterior space 64. A resealable leak-proof or gastight closure mechanism 70 is disposed along inner surfaces 72, 74 of the respective first and second sidewalls 52, 54 near the mouth 66 and extends between the peripheral edge 56 and the peripheral edge 60 of the pouch 50 to allow the mouth 66 to be repeatedly sealed and unsealed if desired. Protuberances, for example, ridges 76, may also be disposed on the inner surfaces 72, 74 between the closure mechanism 70 and the top edge 68, to provide increased traction in a convenient area for a user to grip when trying to open the sealed pouch 50.

Figure 1A:
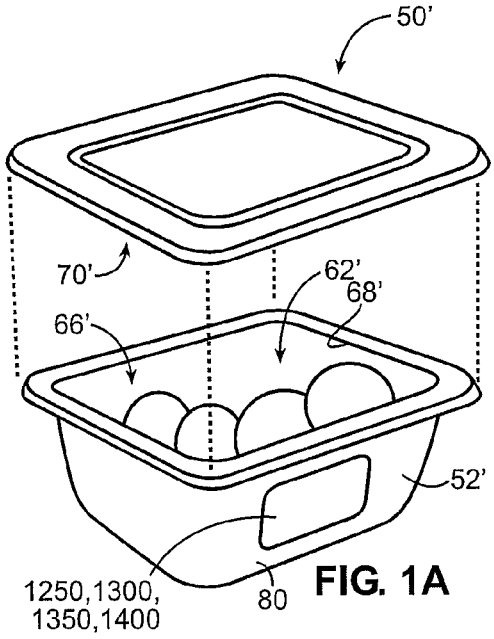
FIG. 1A is an isometric view of another embodiment of an evacuable container.

In another embodiment of a container, illustrated in FIG. 1A, an evacuable hard-walled container 50' includes a hard sidewall 52' that defines an interior space 62' and a mouth or opening 66' along a top edge 68' of the container 50'. A gastight removable lid 70' may be applied over the opening 66' by a snap fit or other method of attachment known to one having skill in the art, to provide a gastight seal between the interior space 62' and an exterior space 64'.

Figure 2:
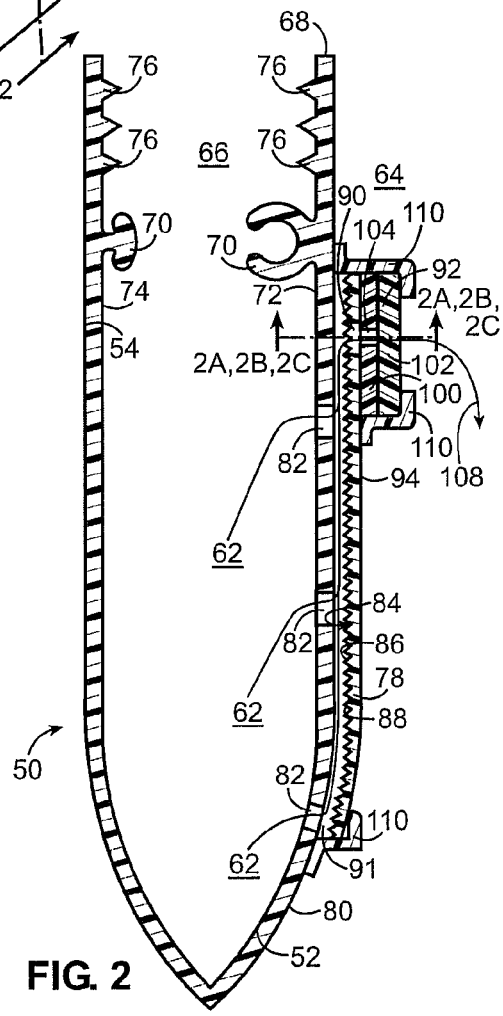
FIG. 2 is a cross-sectional view of the evacuable container of FIG. 1, taken generally along the lines 2-2 in FIG. 1, with features behind the plane of cross section omitted for clarity.

The resealable gastight closure mechanism 70 is shown in FIG. 2 as male and female interlocking closure profiles. However, the configuration and geometry of the interlocking profiles that comprise the gastight closure mechanism 70 may vary as known to those skilled in the art. For example, in one embodiment, one or both of the interlocking profiles may include bumps or grooves in order to provide a tactile sensation, such as a series of clicks, as a user draws the fingers along the closure mechanism 70 to seal the mouth 66. Further, in some embodiments, a sealing material, such as a polyolefin material or a caulking composition, such as silicone grease, may be disposed on or in the interlocking profiles to fill in gaps or spaces therein when occluded. The ends of the closure mechanism 70 may also be welded or sealed by ultrasonic vibrations as is known in the art. Illustrative interlocking profiles, sealing materials, tactile or audible closure elements, and/or end seals useful in the present disclosure include those disclosed in, for example, Pawloski U.S. Pat. No. 4,927,474, Dais et al. U.S. Pat. Nos. 5,070,584, 5,478,228, and 6,021,557, Tomic et al. U.S. Pat. No. 5,655,273, Sprehe U.S. Pat. No. 6,954,969, Kasai et al. U.S. Pat. No. 5,689,866, Ausnit U.S. Pat. No. 6,185,796, Wright et al. U.S. Pat. No. 7,041,249, Pawloski et al. U.S. Pat. No. 7,137,736, Anderson U.S. Patent Application Publication No. 2004/0091179, now U.S. Pat. No. 7,305,742, Pawloski U.S. Patent Application Publication No. 2004/0234172, now U.S. Pat. No. 7,410,298, Tilman et al. U.S. Patent Application Publication No. 2006/0048483, now U.S. Pat. No. 7,290,660, and Anzini et al. U.S. Patent Application Publication Nos. 2006/0093242 and 2006/0111226. Other interlocking profiles useful in the present disclosure include those disclosed in, for example, U.S. patent application Ser. No. 11/725,120, filed Mar. 16, 2007, now U.S. Pat. No. 7,886,412, U.S. patent application Ser. No. 11/818,586, now U.S. Pat. No. 7,946,766, and Ser. No. 11/818,593, now U.S. Pat. No. 7,784,160, each filed on Jun. 15, 2007, and U.S. patent application Ser. No. 12/146,015, filed on Jun. 25, 2008, now U.S. Patent Application Publication No. 2009/0324141. It is further appreciated that the closure mechanism 70 disclosed herein may be operated by hand, or a slider (not shown) may be used to assist in occluding and de-occluding the interlocking profiles.

Referring to FIGS. 1 and 2, in one embodiment, a strip or sheet 78 of material is disposed over an exterior side 80 of a sidewall, for example, the first sidewall 52. The sheet 78 may be disposed over only a portion of the first sidewall 52, including, for example, along one, any, or all the peripheral edges 56, 58, 60, in a center portion, along the top edge 68, spanning the center portion between two or more of the edges, or diagonally. The sheet 78 of material may have any shape as desired, including, for example, circular, rectangular, or any polygonal shape, an X-shape, a T-shape, an annular shape, or a shape of other letters or combinations of letters that may form words or indicia. The sheet 78 may also be disposed over substantially all of the first sidewall 52, as illustrated in FIG. 1.

One or more first apertures 82 are disposed through the first sidewall 52 and may be any shape or size as desired, including, for example, slits, punchouts, pinholes, and combinations thereof. Illustrative apertures applied to a pouch sidewall and useful in the present disclosure may include those disclosed in Porchia et al. U.S. Pat. No. 5,492,705. Interconnecting flow channels 84 are formed by a texture or an embossment 86 on at least a first side 88 of the sheet 78. The texture 86 may be disposed on a portion of or all of the first side 88, and may be formed into any desired pattern of shapes, letters, or indicia. For example, the sheet 78 may be substantially square with only a narrow rectangular region of texture disposed along an edge of the sheet. As shown in FIG. 2C, the texture or embossment 86 could also be formed on the exterior surface 80 of the first sidewall 52 in an area that is covered by the sheet 78, in addition to or instead of being formed on the sheet 78. A flow channel chamber 91 is defined between the sheet 78 and the first sidewall 52 and is accessible by the one or more first apertures 82 and a second aperture 90 that is disposed through the sheet 78. Fluid communication between the one or more first apertures 82 and the second aperture 90 may be facilitated and maintained by the flow channels 84 within the flow channel chamber 91. Illustrative flow channels useful in the present disclosure may include those disclosed in Zimmerman et al. U.S. Patent Application Publication No. 2005/0286808, now U.S. Pat. No. 7,726,880 and Tilman et al. U.S. Pat. No. 7,290,660. Other flow channels useful in the present disclosure may include those disclosed in, for example, U.S. patent application Ser. No. 11/818,584, filed Jun. 15, 2007, now U.S. Pat. No. 7,887,238.

In this embodiment, check valve 92 is disposed on a second side 94 of the sheet 78 in sealed fluid communication with the second aperture 90. The check valve 92 allows gas to flow from the interior 62 to the exterior 64, but restricts gas from flowing from the exterior 64 to the interior 62. In one embodiment, the check valve 92 may be coextensive with the sheet 78, or may cover a portion that spans the sheet 78 from the peripheral edge 56 to the peripheral edge 60, as illustrated in FIG. 1. In other embodiments, the check valve 92 may comprise a round shape 96 or a square shape 98 covering only a portion of the sheet 78, as illustrated in FIG. 1, or the check valve 92 may have any other shape, extent, or orientation relative to the sheet 78 as desired and as known to those of skill in the art. Although not shown, in some embodiments, it may be desirable, for ease of manufacture or other reasons, to utilize a check valve 92 that has a larger extent than the sheet 78.

Figure 2A:
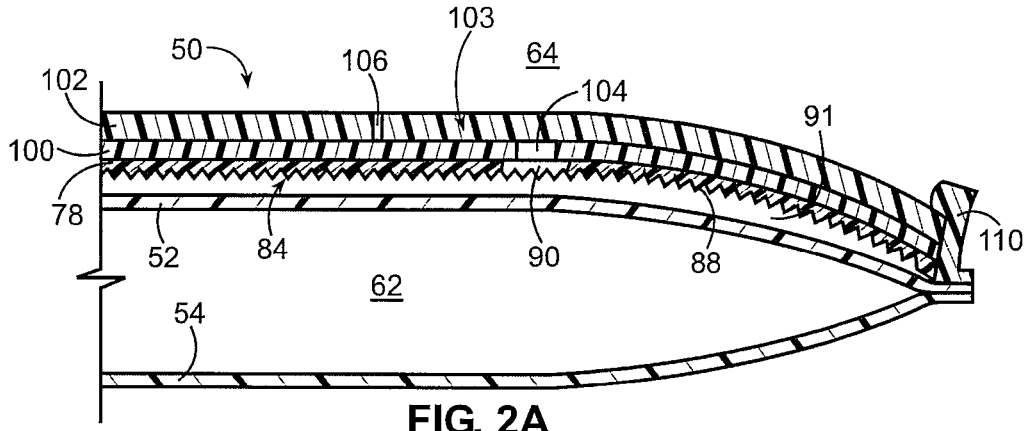
FIG. 2A is a cross-sectional view of the evacuable container of FIG. 1, taken generally along the lines 2A-2A in FIG. 2, with features behind the plane of cross section omitted for clarity.
Figure 2B:
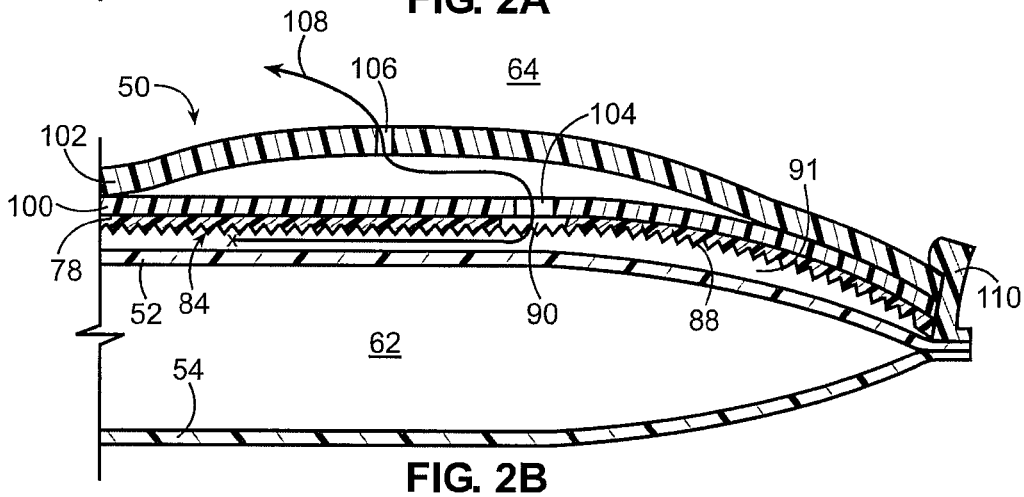
FIG. 2B is a cross-sectional view of the evacuable container of FIG. 1, taken generally along the lines 2B-2B in FIG. 2, with features behind the plane of cross section omitted for clarity.
Figure 2C:
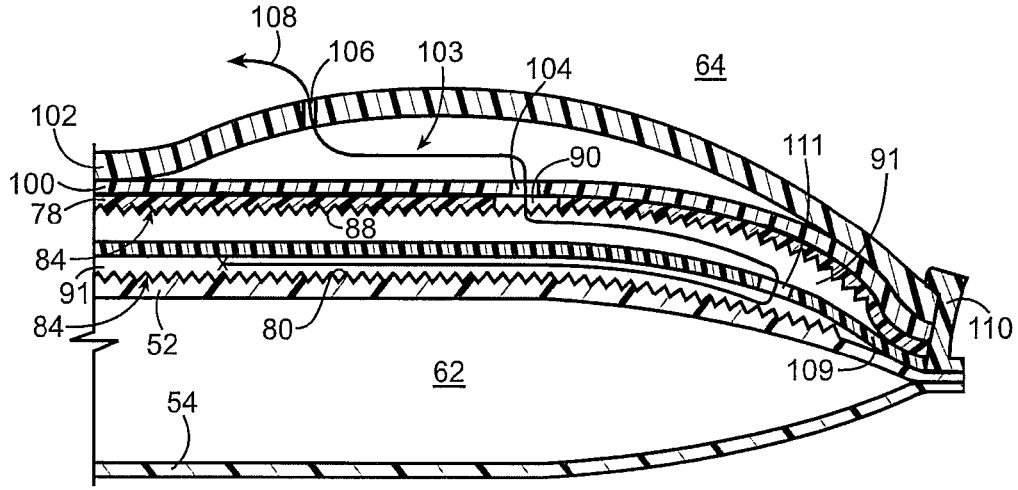
FIG. 2C is a cross-sectional view of another embodiment of an evacuable container, taken generally along the lines 2C-2C in FIG. 2, with features behind the plane of cross section omitted for clarity.

Illustratively, the check valve 92 may include a first film layer 100 and a second film layer 102, as shown in FIGS. 2, 2A, and 2B. A third aperture 104 may be disposed through the first film layer 100 and may provide fluid communication between the second film layer 102 and the second aperture 90. A fourth aperture or slit 106 may be provided through the second film layer 102 as illustrated in FIGS. 2A and 2B, or the second film layer 102 may be in the form of a flap that has only a portion of a periphery thereof sealed to the first film layer 100. Referring to FIG. 2A, the first and second film layers 100, 102 may form a gastight seal therebetween in a sealing region 103 disposed between the third and fourth apertures 104, 106. The second aperture 90 is in fluid communication with the interior 62 via the flow channels 84 and the flow channel chamber 91. Therefore, a vacuum drawn from the exterior 64 over the third and fourth apertures 104, 106 reduces the exterior 64 gas pressure relative to the interior 62 gas pressure and causes a pressure imbalance across the second film layer 102 at the third aperture 104. The relatively higher interior gas pressure displaces the second film layer 102 outwardly at the third aperture 104, causing the second film layer 102 to separate from the first film layer 100. Separation of the first and second film layers 100, 102 opens an evacuation path 108, as shown by the curved arrow in FIGS. 2, 2B, and 2C, for gas to escape to the exterior 64.

As best fully seen in FIG. 2, the evacuation path 108 begins within the interior 62 and passes from the interior through the one or more first apertures 82 into the flow channel chamber 91. The path 108 follows the flow channel chamber 91 along the flow channels 84 in the first side 88 of the sheet 78 to the second aperture 90. The path 108 then leaves the flow channel chamber 91 through the second aperture 90 and the coincident third aperture 104. The path 108 passes through the separation between the first and second film layers 100, 102 and passes out of the check valve 92 through the fourth aperture or slit 106, which is not visible in the cross-sectional view of FIG. 2. Escape of gas from the interior 62 to the exterior 64 tends to equalize the pressure imbalance across the second film layer 102, causing the separation between the first and second film layers 100, 102 to diminish, until a gastight seal in the sealing region 103 is reestablished therebetween.

Illustrative valves useful in the present disclosure include those disclosed in, for example, Newrones et al. U.S. Patent Application Publication No. 2006/0228057, now U.S. Pat. No. 7,837,387, Buchman U.S. Patent Application Publication No. 2007/0172157, and Tilman et al. U.S. Patent Application Publication No. 2007/0154118. Other valves useful in the present disclosure include those disclosed in, for example, U.S. patent application Ser. No. 11/818,586, now U.S. Pat. No. 7,946,766, Ser. No. 11/818,591, now U.S. Pat. No. 7,874,731, and Ser. No. 11/818,592, now U.S. Pat. No. 7,967,509, each filed on Jun. 15, 2007. Although not shown, in some embodiments, an evacuation device such as a pump may be used to provide a source of vacuum to evacuate gas from the pouch 50 through, for example, the evacuation path 108. Illustrative evacuation pumps or devices useful in the present disclosure include those disclosed in, for example, U.S. patent application Ser. No. 11/818,703, filed on Jun. 15, 2007, now U.S. Patent Application Publication No. 2008/0308177, and U.S. patent application Ser. No. 12/008,164, filed on Jan. 9, 2008, now U.S. Patent Application Publication No. 2009/0175747.

It is also contemplated that one or more additional panels 109 may be sandwiched between the first side 88 of the sheet 78 and the exterior 80 of the first sidewall 52, as illustrated in FIG. 2C. In this embodiment, a single additional panel 109 has an aperture 111 and provides a somewhat tortuous path through the flow channel chamber 91, as indicated by the evacuation path 108. Such a tortuous path may be useful to trap liquids within the flow channel chamber 91 so that, for example, the liquids do not foul or soil the evacuation device.

The sheet 78 may be attached at least around an entire periphery thereof to the first sidewall 52, for example, by a thermoplastic weld layer 110, as illustrated in FIG. 2, by an adhesive, by a direct weld, or otherwise as known by persons having skill in the art. Similarly, the check valve 92, and the first and second film layers 100, 102 that may comprise the check valve 92 may also be attached to one another and to the sheet 78 and the first sidewall 52 by a thermoplastic weld layer 110, as illustrated in FIG. 2, by an adhesive, by a direct weld, or otherwise as known by persons having skill in the art.

In one embodiment, the first and second sidewalls 52, 54 and/or the closure mechanism 70 are formed from thermoplastic resins by known extrusion methods. For example, the sidewalls 52, 54 may be independently extruded of thermoplastic material as a single continuous or multi-ply web, and the closure mechanism 70 may be extruded of the same or different thermoplastic material(s) separately as continuous lengths or strands. Illustrative thermoplastic materials include polypropylene (PP), polyethylene (PE), metallocene-polyethylene (mPE), low density polyethylene (LDPE), linear low density polyethylene (LLDPE), ultra low density polyethylene (ULDPE), biaxially-oriented polyethylene terephthalate (BPET), high density polyethylene (HDPE), polyethylene terephthalate (PET), among other polyolefin plastomers, and combinations and blends thereof.

Further, the inner surfaces 72, 74 of the respective first and second sidewalls 52, 54 or a portion or area thereof may be, for example, composed of a polyolefin plastomer such as an AFFINITY™ resin manufactured by Dow Plastics. One or more of the first and second sidewalls 52, 54 in other embodiments may also be formed of air-impermeable film. An example of an air-impermeable film includes a film having one or more barrier layers, such as an ethylene-vinyl alcohol copolymer (EVOH) ply or a nylon ply, disposed between or on one or more of the plies of the first and second sidewalls 52, 54. The barrier layer may be, for example, adhesively secured between PP and/or LDPE plies to provide a multilayer film. Other additives, such as colorants, slip agents, and antioxidants, including, for example, talc, oleamide or hydroxyl hydrocinnamate, may also be added as desired. In another embodiment, the resealable closure mechanism 70 may be extruded primarily of molten PE or LDPE with various amounts of slip component, colorant, and/or talc additives in a separate process. The fully formed closure mechanism 70 may be attached to the pouch body, for example, using a strip of molten thermoplastic weld material, an adhesive, a direct weld, or otherwise as known by those skilled in the art. Other thermoplastic resins and air-impermeable films useful in the present disclosure include those disclosed in, for example, Tilman et al. U.S. Patent Application Publication No. 2006/0048483, U.S. Pat. No. 7,290,660.

Figure 3:
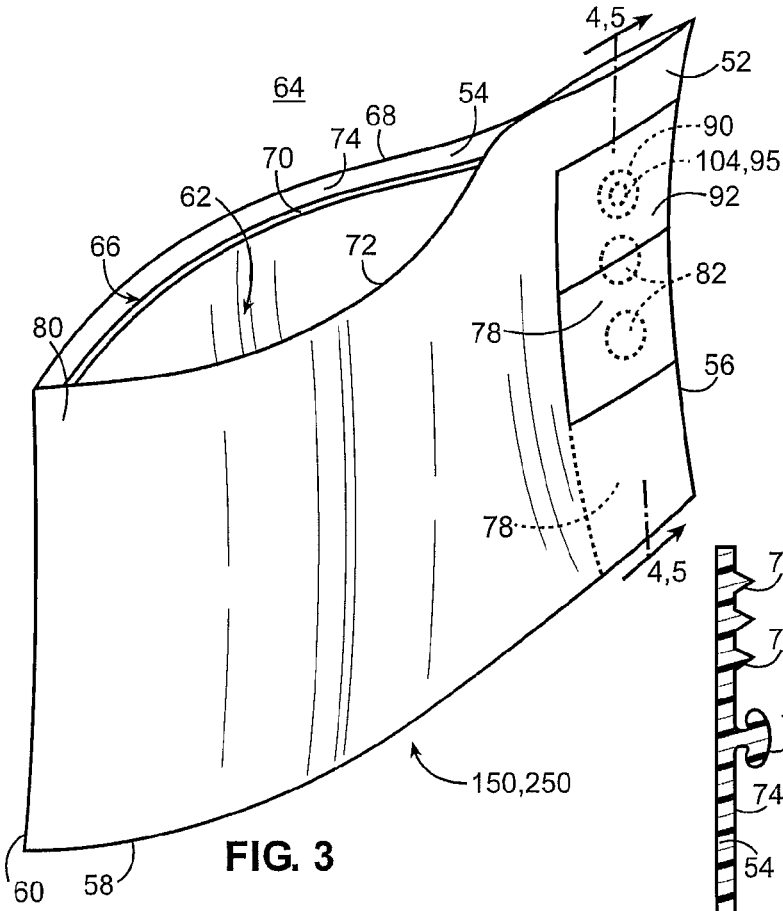
FIG. 3 is an isometric view of other embodiments of an evacuable container.

FIG. 3 illustrates other embodiments of an evacuable pouch 150, 250 that include the sheet 78 disposed over a rectangular portion of the first sidewall 52 and having a long side coincident with the peripheral edge 56. The sheet 78 may be disposed to extend to the peripheral edge 58, as indicated by the dashed lines, or may be configured to have any other desired extent or orientation as described hereinabove.

Figure 4:
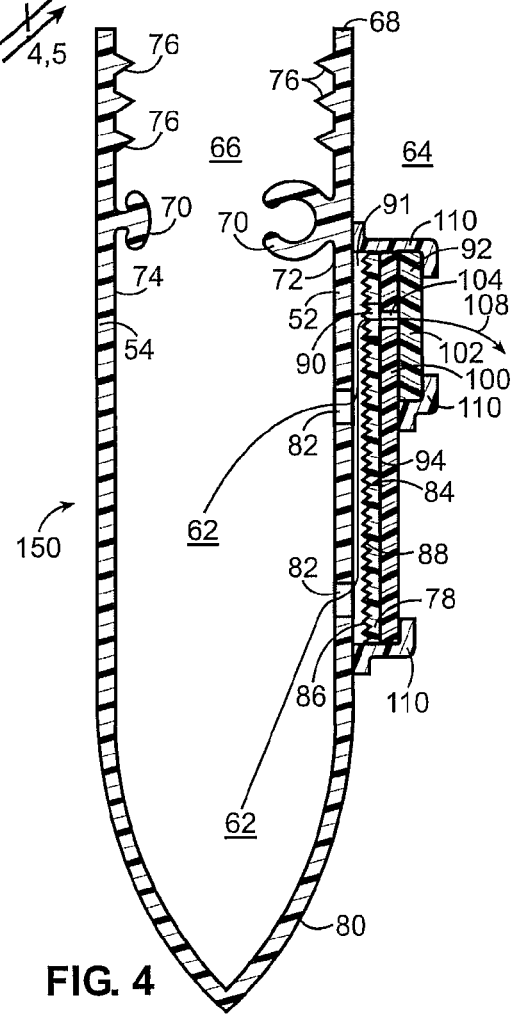
FIG. 4 is a cross-sectional view of one embodiment of the evacuable container of FIG. 3, taken generally along the lines 4-4 in FIG. 3, with features behind the plane of cross section omitted for clarity.
Figure 5:
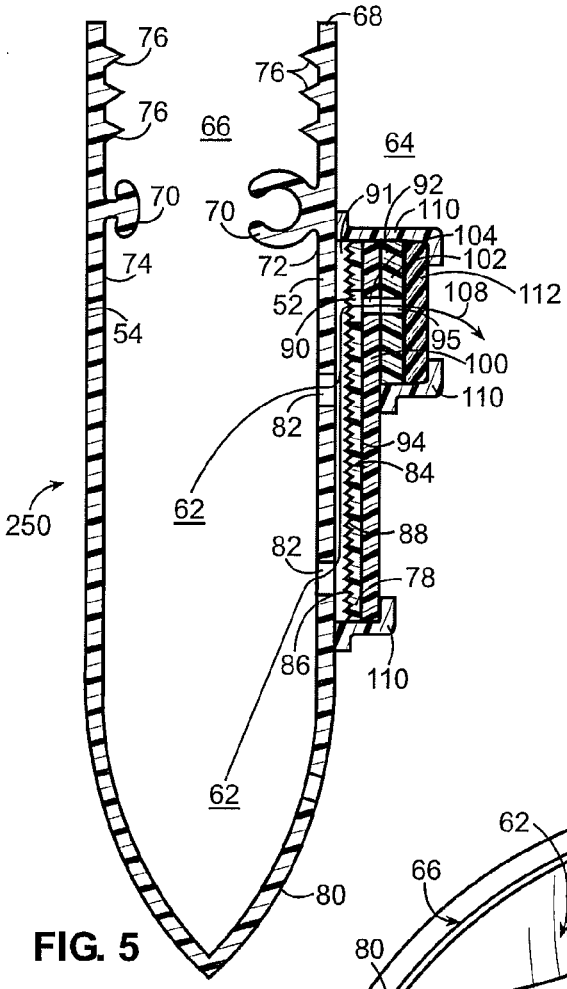
FIG. 5 is a cross-sectional view of another embodiment of the evacuable container of FIG. 3, taken generally along the lines 5-5 in FIG. 3, with features behind the plane of cross section omitted for clarity.

The embodiment of the evacuable pouch 150 illustrated in FIG. 4 is substantially similar to the embodiment described with regard to FIGS. 1 and 2, except that the first film layer 100 is coextensive with the sheet 78. The embodiment of the evacuable pouch 250 illustrated in FIG. 5 is substantially similar to the embodiment described with regard to FIG. 4, except that the check valve 92 includes a third film layer 112 that is coextensive with the second film layer 102. The third film layer 112 includes the fourth aperture or slit 106 (not visible in this cross-sectional view) disposed therethrough that is offset from a fifth aperture 95 that is coincident with the third aperture 104. The addition of the third film layer 112 may allow the sheet 78 to be sandwiched without further physical attachment between the first sidewall 52 and the first film layer 100. The sheet 78 thus sandwiched may be textured on both sides, may have multiple (not shown) second apertures 90 disposed therethrough, and may provide a somewhat tortuous path through the flow channel chamber 91, similar to the embodiment described with regard to FIG. 2C.

Figure 6:
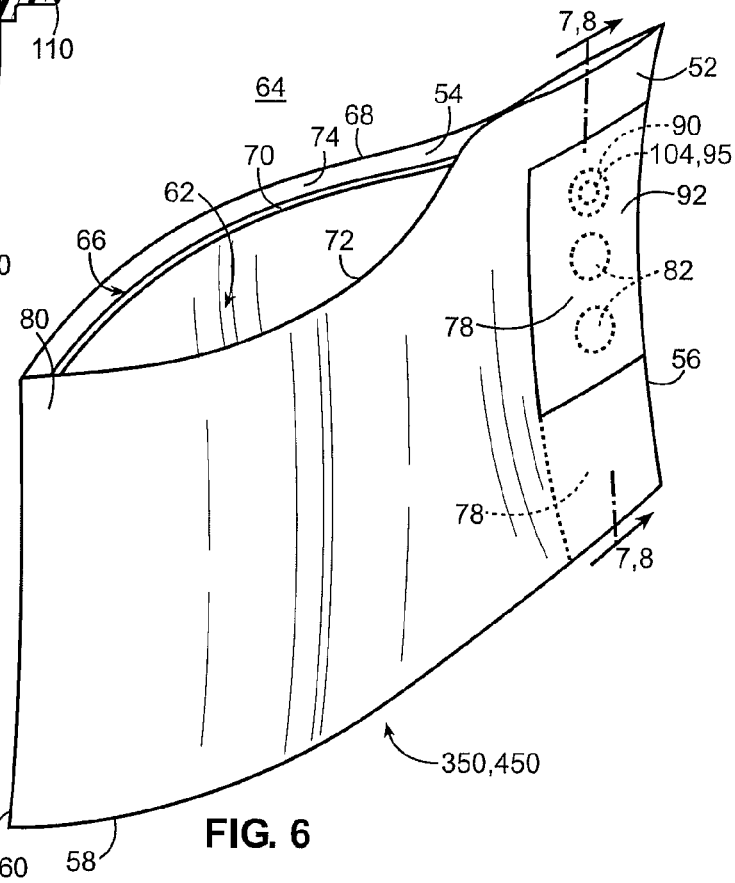
FIG. 6 is an isometric view of further embodiments of an evacuable container.
Figure 7:
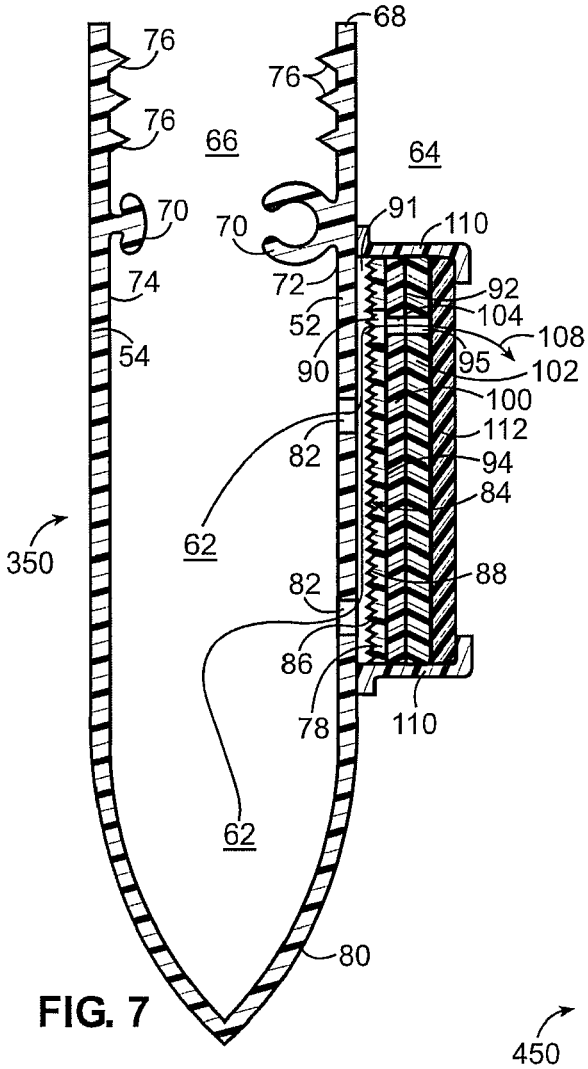
FIG. 7 is a cross-sectional view of one embodiment of the evacuable container of FIG. 6, taken generally along the lines 7-7 in FIG. 6, with features behind the plane of cross section omitted for clarity.
Figure 8:
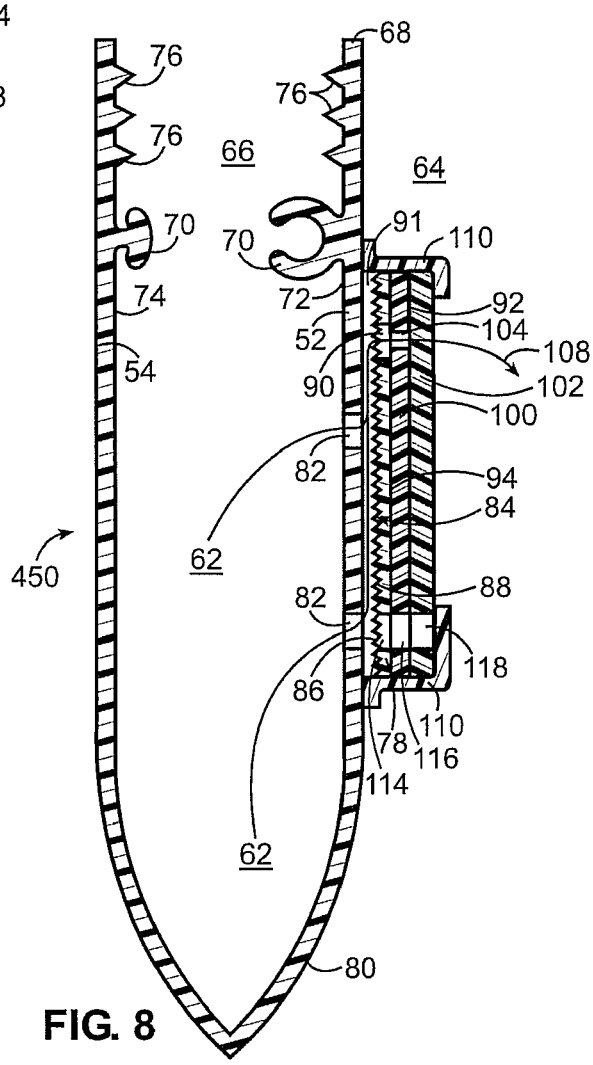
FIG. 8 is a cross-sectional view of another embodiment of the evacuable container of FIG. 6, taken generally along the lines 8-8 in FIG. 6, with features behind the plane of cross section omitted for clarity.

Referring to FIGS. 6-8, further embodiments of an evacuable pouch 350, 450 are illustrated. FIG. 7 illustrates the embodiment of the evacuable pouch 350 that is substantially similar to the embodiment described with regard to FIG. 5 except that the second and third film layers 102, 112 are coextensive with the first film layer 100. The embodiment of the evacuable pouch 450 is substantially similar to the embodiment described with regard to FIG. 7, except that the evacuable pouch 450 lacks the third film layer 112. In addition, sixth, seventh, and eighth apertures 114, 116, and 118 are respectively disposed through the sheet 78, the first film layer 100, and the second film layer 102 coincidentally with one of the one or more first apertures 82. The sixth, seventh, and eighth apertures 114, 116, 118 are sealed from fluid communication with the exterior 64 of the pouch 350, 450 by, for example, the thermoplastic weld layer 110, an adhesive, or otherwise as known to a person of skill in the art. In one embodiment, the coincidentally disposed apertures 82, 114, 116, 118 may be produced by a single punch process applied to the first sidewall 52 after the sheet 78 and the first and second film layers 100, 102 have been applied thereto, but before application of the thermoplastic weld layer 110.

Figure 9:
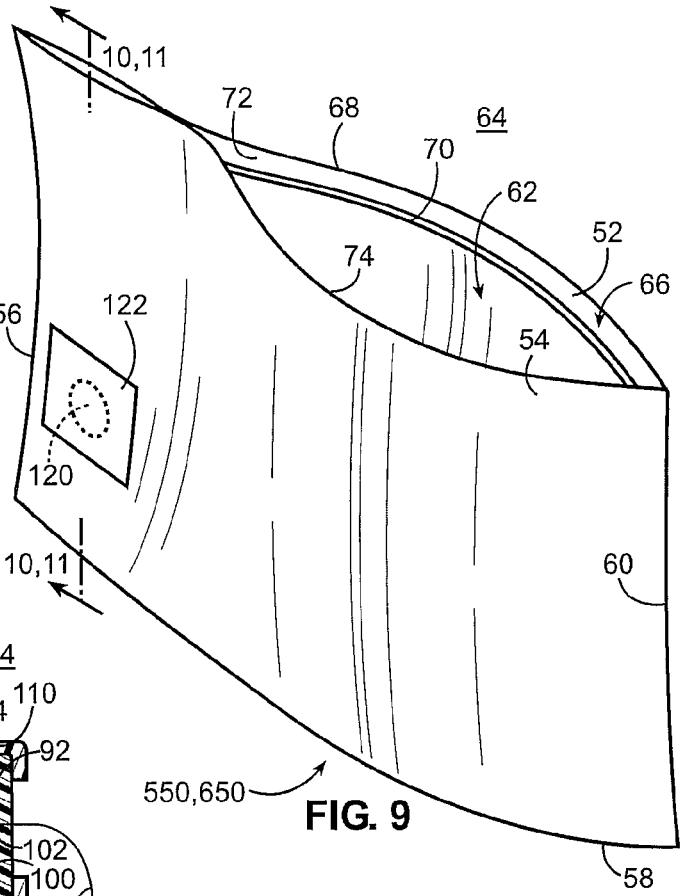
FIG. 9 is an isometric view of yet further embodiments of an evacuable container.
Figure 10:
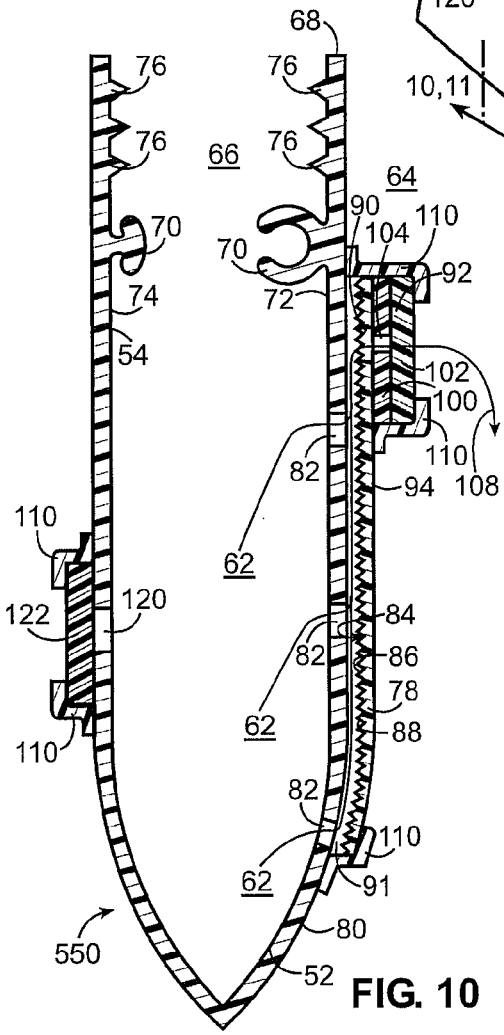
FIG. 10 is a cross-sectional view of one embodiment of the evacuable container of FIG. 9, taken generally along the lines 10-10 in FIG. 9, with features behind the plane of cross section omitted for clarity.
Figure 11:
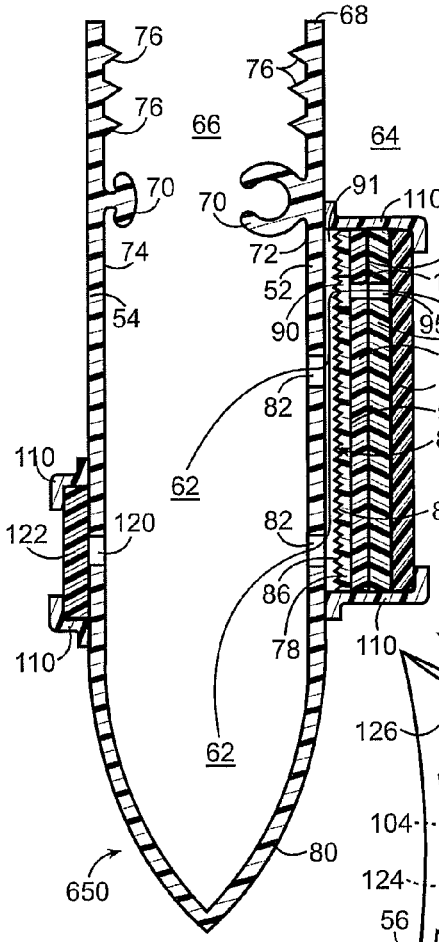
FIG. 11 is a cross-sectional view of another embodiment of the evacuable container of FIG. 9, taken generally along the lines 11-11 in FIG. 9, with features behind the plane of cross section omitted for clarity.

Other embodiments of an evacuable pouch 550, 650 are illustrated in FIGS. 9-11. A reverse view of the pouch 550, 650 with the first sidewall 52 behind the second sidewall 54 is shown in FIG. 9. A ninth aperture 120 is disposed through the second sidewall 54 coincidentally with one of the one or more first apertures 82. A patch 122 is sealingly disposed over the ninth aperture 120. The evacuable pouch 550 illustrated in FIG. 10 is substantially similar to the evacuable pouch 50 described with regard to FIG. 2 except that this embodiment includes the ninth aperture 120 and the patch 122. Likewise, the evacuable pouch 650 illustrated in FIG. 11 is substantially similar to the evacuable pouch 350 described with regard to FIG. 7 except that this embodiment includes the ninth aperture 120 and the patch 122. The coincidentally disposed apertures 82, 120 may be produced by a single punch process applied to the opposing first and second sidewalls 52, 54 of a fully manufactured and sealed pouch before application of the sheet 78 or the check valve 92. The ninth aperture 120 is sealed from fluid communication with the exterior 64 of the pouch 550, 650 by, for example, a thermoplastic weld layer 110 as shown in FIGS. 10 and 11, an adhesive, or otherwise as known to a person of skill in the art.

Figure 12:
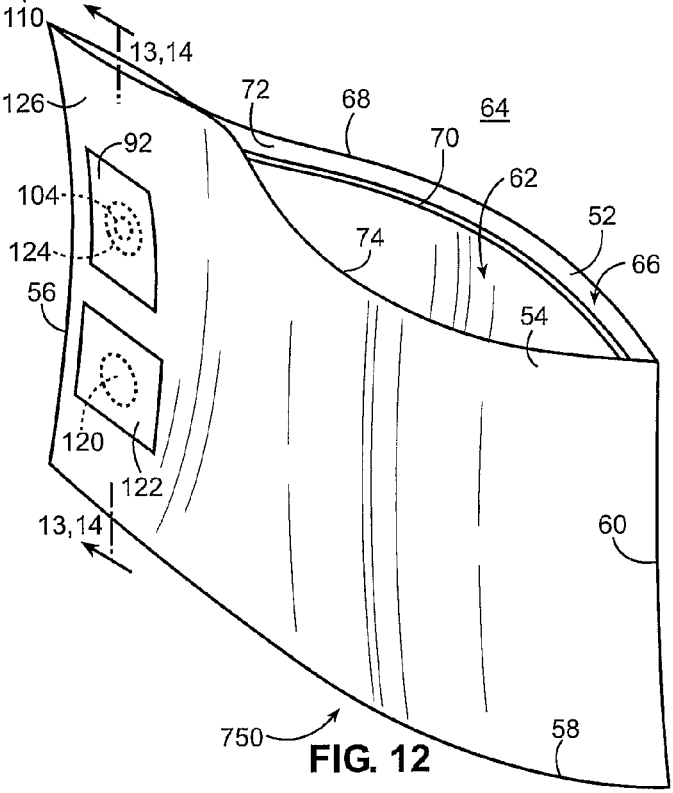
FIG. 12 is an isometric view of still further embodiments of an evacuable container.
Figure 13:
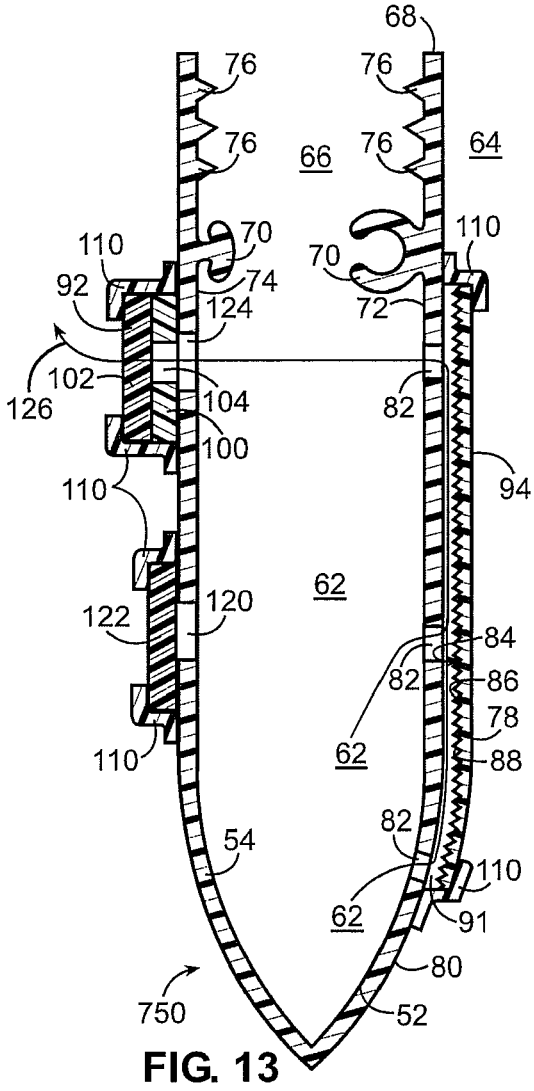
FIG. 13 is a cross-sectional view of one embodiment of the evacuable container of FIG. 12, taken generally along the lines 13-13 in FIG. 12, with features behind the plane of cross section omitted for clarity.
Figure 14:
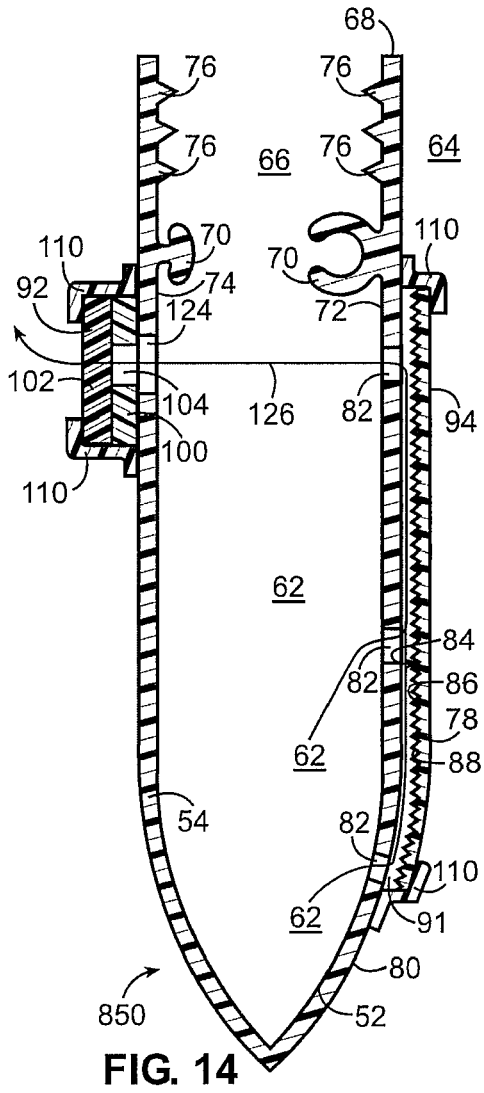
FIG. 14 is a cross-sectional view of another embodiment of the evacuable container of FIG. 12, taken generally along the lines 14-14 in FIG. 12, with features behind the plane of cross section omitted for clarity.

Referring to FIGS. 12 and 13, another embodiment of an evacuable pouch 750 is illustrated that includes a tenth aperture 124 disposed through the second sidewall 54. This embodiment is substantially similar to the embodiment of the evacuable pouch 550 described with regard to FIG. 10, except that the check valve 92 is disposed over the tenth aperture 124 on an exterior side 126 of the second sidewall 54 and the sheet 78 lacks the second aperture 90. The tenth aperture 124 is disposed through the second sidewall 54 coincidentally with one of the one or more first apertures 82. This coincidental orientation of the apertures 82, 124 may facilitate production by a single punch process applied to the opposing first and second sidewalls 52, 54 of a fully manufactured and sealed pouch before application of the sheet 78 or the check valve 92. In addition, the coincidental disposition of the apertures 82, 124 also may facilitate maintenance of fluid communication between the third aperture 104 of the check valve 92 and the flow channels 84 within the flow channel chamber 91. An evacuation path for this embodiment is illustrated in FIG. 13 by the curved arrow 126, which exits the check valve 92 through the fourth aperture or slit 106 that is not visible in the cross-sectional view of FIG. 13. A further embodiment of an evacuable pouch 850 is illustrated in FIG. 14. This embodiment is substantially similar to the embodiment described with regard to FIG. 13, except that this embodiment lacks the ninth aperture 120 and the patch 122.

Figure 15:
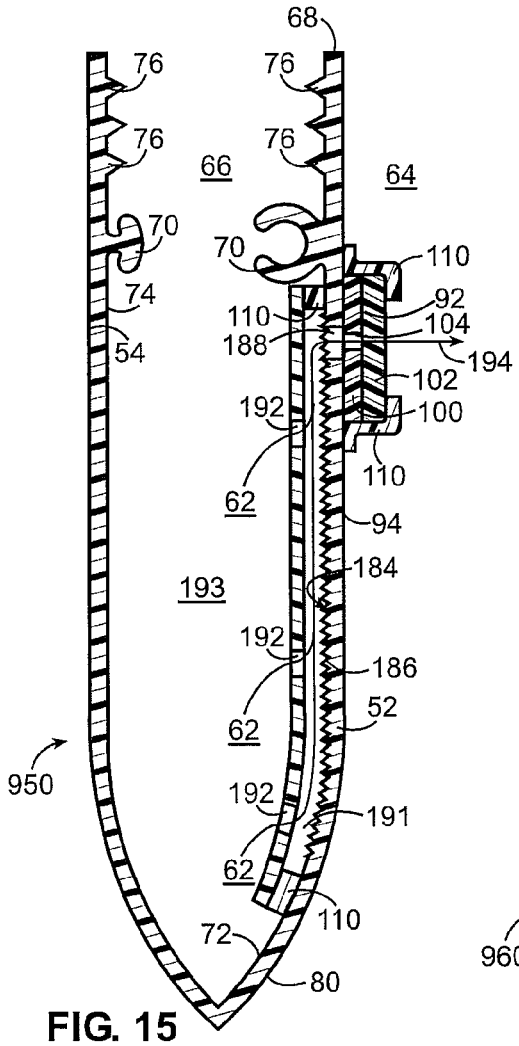
FIG. 15 is a cross-sectional view of another embodiment of an evacuable container that is similar to the embodiment depicted in FIG. 2.

Referring to FIG. 15, a further embodiment of an evacuable pouch 950 is illustrated that is similar to the embodiment described with regard to FIG. 2, except for the following differences. This embodiment lacks the sheet 78 of material disposed over the exterior side 80 of the first sidewall 52. Instead, interconnecting flow channels 184 are formed by a texture or an embossment 186 on the interior surface 72 of a portion of the first sidewall 52. The check valve 92 is disposed in sealed fluid communication on the exterior surface 80 of the first sidewall 52 over an eleventh aperture 188 disposed therethrough. An interior panel 190 is disposed over the flow channels 184 and sealingly attached along the entire periphery thereof to the interior surface 72 of the first sidewall 52 to define a flow channel chamber 191 between the interior surface 72 and the interior panel 190 with access openings defined by the eleventh aperture 188 and one or more twelfth apertures 192. A pouch interior volume 193 is defined by the volume between the first and second sidewalls 52, 54, outside of the flow channel chamber 191.

The interior panel 190 may be smooth or may be textured as described below, and includes the one or more twelfth apertures 192 disposed therethrough. At least the perimeter of interior panel 190 may be sealingly attached to the interior surface 72, for example, by a thermoplastic weld layer 110, an adhesive, or otherwise as known to a person of skill in the art to define the flow chamber 191. The flow channel chamber 191 defined between the interior panel 190 and the interior surface 72 includes the flow channels 184 and defines an evacuation path illustrated by the curved arrow 194 as shown in FIG. 15 from the interior 62 to the exterior 64. This embodiment may allow the interior panel 190 to be made from a film that does not include an air-impermeable film barrier.

Figure 16:
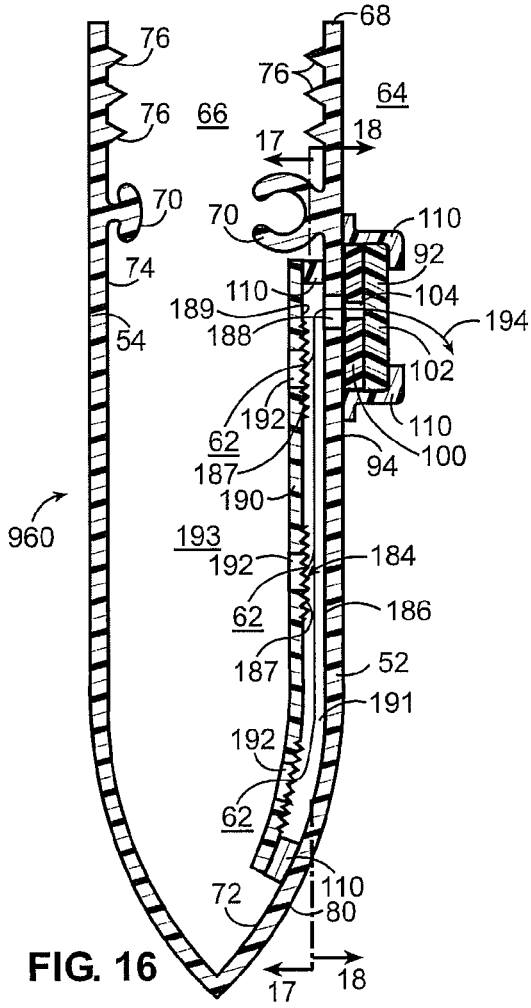
FIG. 16 is a cross-sectional view of a further embodiment of an evacuable container that is similar to the embodiment depicted in FIG. 15.
Figure 17:
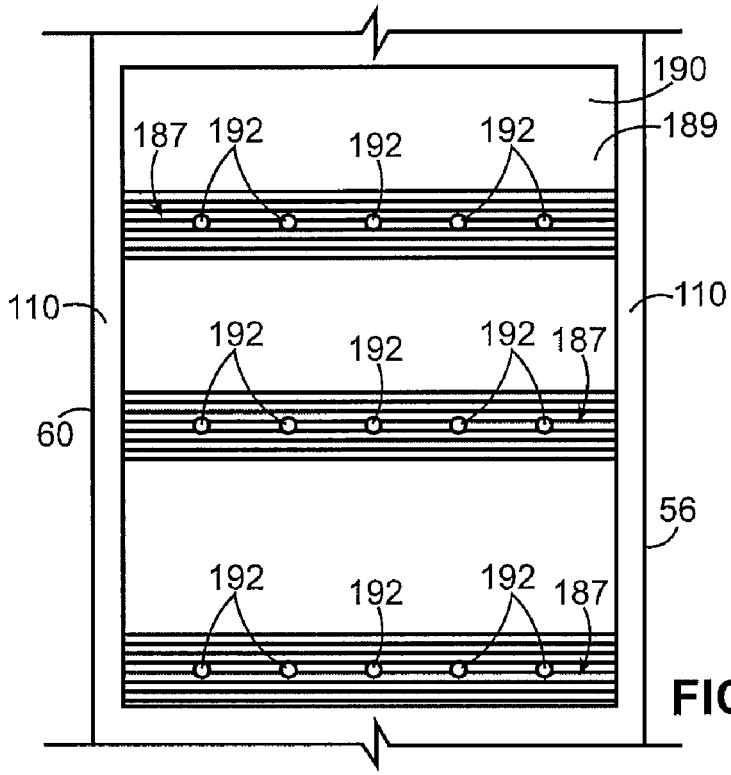
FIG. 17 is a partial cross-sectional view of the evacuable container of FIG. 16, taken generally along the lines 17-17 in FIG. 16.
Figure 18:
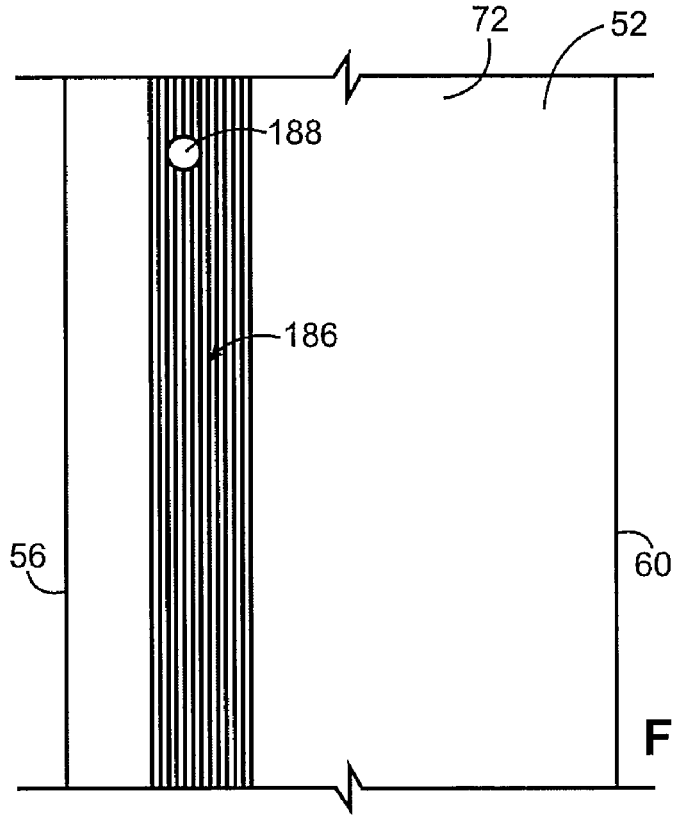
FIG. 18 is a partial cross-sectional view of the evacuable container of FIG. 16, taken generally along the lines 18-18 in FIG. 16.

Referring to FIGS. 16-18, in another embodiment of an evacuable pouch 960, the interior panel 190 may include a texture or embossment 187 on a portion of an outer side 189 thereof that faces the interior surface 72. The texture 187 may be coextensive with the entire outer side 189 or may cover only a desired portion, for example, as shown in FIG. 17. The texture 187 may be oriented or otherwise formed such that combination of the texture 187 with the texture 186 further facilitates formation and maintenance of the flow channels 184. For example, the texture 187 may be comprised of generally horizontal grooves, as shown in FIG. 17, and the texture 186 may be comprised of generally vertical grooves, as shown in FIG. 18. When a vacuum is applied to the evacuable pouch 960, high points of the texture 187 may make contact with high points of the texture 186 so as to inhibit or to prevent meshing of the vertical and horizontal grooves into one another. Any arrangement of non-meshing textured surfaces, including this illustrative arrangement of the textures 186, 187, is contemplated herein and may be used together on the facing surfaces 72 and 189 to inhibit or to prevent the collapse of the flow channels 184 when a vacuum is applied to the evacuable pouch 960.

Figure 19:
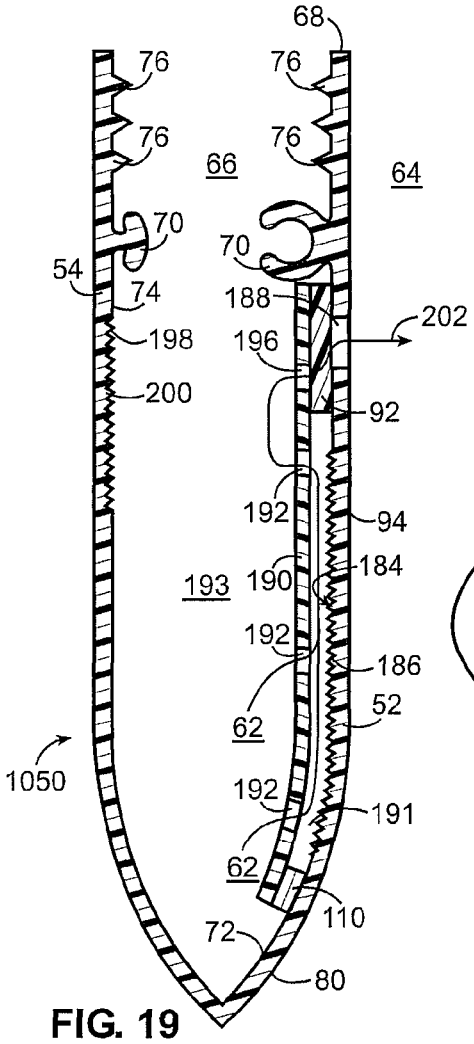
FIG. 19 is a cross-sectional view of yet another embodiment of an evacuable container that is similar to the embodiment depicted in FIG. 15.

Another embodiment of an evacuable pouch 1050 is illustrated in FIG. 19 and is similar to the embodiment described with regard to FIG. 15, except for the following differences. In this embodiment, the check valve 92 is not on an exterior surface of one of the first and second pouch sidewalls 52, 54, but instead is sealingly disposed between the interior surface 72 of the first sidewall 52 and the interior panel 190. The check valve 92 is in fluid communication with a thirteenth aperture 196 disposed through the interior panel 190 and the eleventh aperture 188 disposed through the first sidewall 52. In this embodiment, the check valve 92 is illustrated schematically as a simple block of material and may comprise multiple layers of film as described hereinabove or may have any structure as may be desired or known to one having skill in the art. Interconnecting flow channels 198 are formed by a texture or an embossment 200 on a minor portion of the interior surface 74 of the second sidewall 54 that spans a region that is opposite to the thirteenth aperture 196 and one of the one or more twelfth apertures 192. The orientation of the flow channels 198 immediately opposite to the thirteenth aperture 196 and one of the one or more twelfth apertures 192 may facilitate maintenance of fluid communication between the thirteenth aperture 196 and one of the one or more twelfth apertures 192. An evacuation path from the interior 62 to the exterior 64 of the pouch 1050 may follow the curved arrow 202 as shown in FIG. 19. Similar to the embodiment described with regard to FIG. 15, this embodiment may allow the interior panel 190 to be made from a film that does not include an air-impermeable film barrier.

In other embodiments (not shown), the interconnecting flow channels 198 are disposed on a major portion of the interior surface 74, such as, for example, greater than about 50%, greater than about 75%, greater than about 90%, greater than about 95%, or about substantially the entire interior surface 74. Placement or location of the texture 200 may be independent of the number and/or placement of the twelfth and/or thirteenth apertures 192, 196, respectively, and is illustratively disposed to assist or to facilitate movement of gas from the interior 62 of the evacuable pouch 50 through the eleventh aperture 188.

Figure 20:
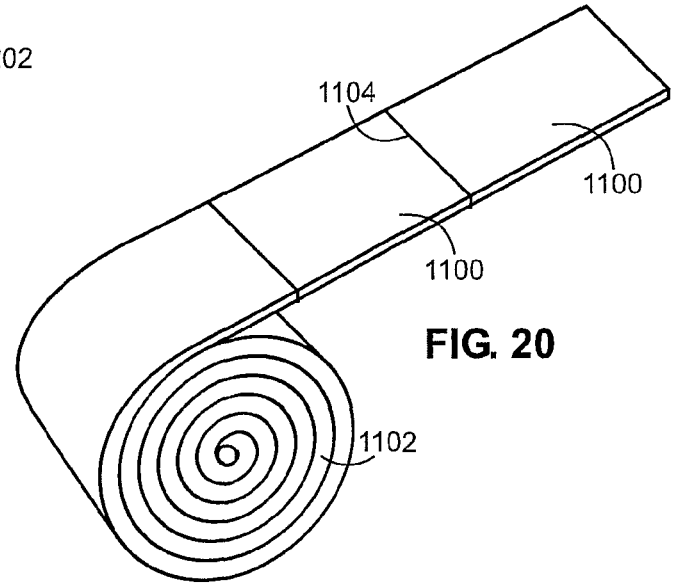
FIG. 20 is a schematic isometric representation of a roll of evacuation strips.
Figure 21:
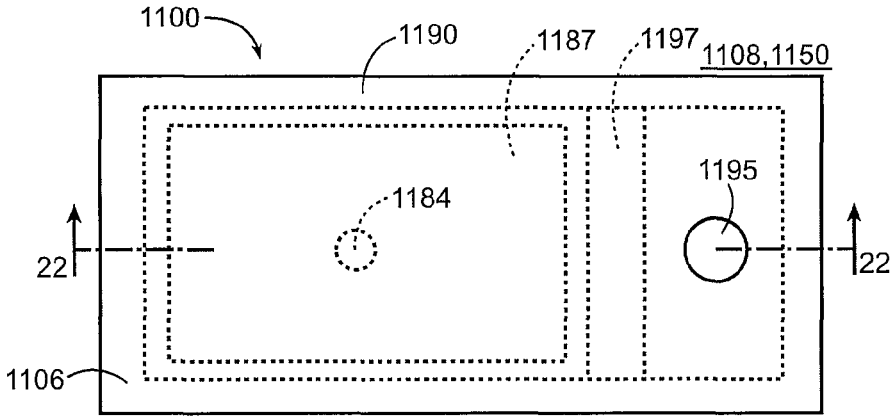
FIG. 21 is a plan view of an embodiment of an evacuation strip attached to a container.
Figure 22:
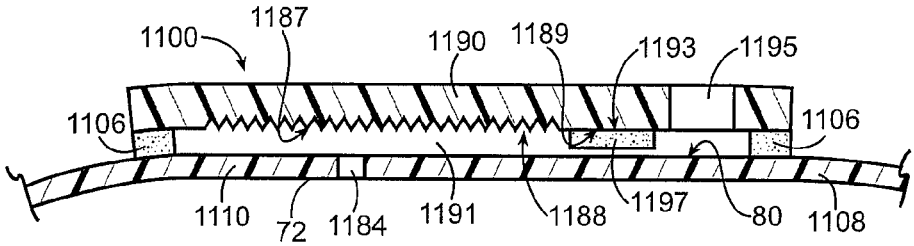
FIG. 22 is a cross-sectional view of the evacuation strip of FIG. 21, taken generally along the lines 22-22 of FIG. 21.

It is also contemplated that any of the external flow channels and valves described herein, for example, the sheet 78 and the check valve 92 illustrated in FIG. 2, could be manufactured as a unitary evacuation strip 1100, illustratively shown in FIGS. 20-22. For example, as shown in FIG. 20, a plurality of the evacuation strips 1100 could be supplied by a tape roll 1102 with perforations 1104 between each of the individual evacuation strips 1100 to allow separation thereof. The evacuation strip 1100 may have any convenient shape, for example, including rectangular, circular, elliptical, star shaped, or as desired to match a seating surface of an evacuation device (not shown) that may be applied to the evacuation strip.

Referring to FIGS. 21-22, each of the evacuation strips 1100 could be applied to a wall 1110 of a container 1108, for example, a non-evacuable pouch or a hard-walled container such as the embodiment of the hard-walled container 50' described with regard to FIG. 1A hereinabove, during manufacture of the non-evacuable pouch or the hard-walled container, or as part of a post-manufacture application process to a completed non-evacuable pouch or hard-walled container. For example, the evacuation strip 1100 can be applied to the interior surface 72 and/or the exterior surface 80 of the container 1108. The evacuation strip 1100 may include a texture or embossment 1187 on a portion of an interior side 1189 of a strip of material 1190 that faces the container 1108 upon application of the evacuation strip 1100 thereto to create a flow channel chamber 1191, for example, to transform the completed non-evacuable pouch into an evacuable pouch. The texture 1187 provides flow channels 1188 that may be configured to provide fluid communication between an aperture 1184 disposed through the wall 1110 of the container 1108 and a sealing region 1193. The sealing region 1193 is disposed adjacent to an aperture 1195 disposed through the strip of material 1190 and acts as a check valve by allowing gas to be evacuated from the container 1108 while providing a gastight seal against gas flowing into the container 1108.

Illustratively, the evacuation strip 1100 may have, for example, a layer of thermoplastic weld material or an adhesive 1106 on an application surface of the strip of material 1190 as a means of attachment to the container 1108. The cross section depicted in FIG. 22 illustrates the evacuation strip 1100 attached to the container 1108 prior to application of a vacuum over the evacuation strip 1100. When the container 1108 is under a vacuum, the strip of material 1190 may flexibly collapse against the container 1108 to form a gastight seal between the surface 80 and the interior side 1189 of the strip of material 1190 in the sealing region 1193. Further vacuum may be drawn on the container 1108 by an evacuation device (not shown) placed over the aperture 1195 and a portion of the flow channels 1188 that are in fluid communication with the aperture 1184.

In some instances, the container 1108 may have a surface that is textured or that otherwise does not facilitate formation of a seal when in contact with the sealing region 1193. In such instances, the evacuation strip 1100 may include a second adhesive layer 1197, as shown in FIGS. 21 and 22. The second adhesive layer 1197 may have a thickness that is less than the thickness of the adhesive 1106 such that sealing contact between the second adhesive layer 1197 and the surface 80 is not made until the strip of material 1190 flexibly collapses against the container 1108, for example, when a vacuum is drawn on the container 1108.

Figure 23:
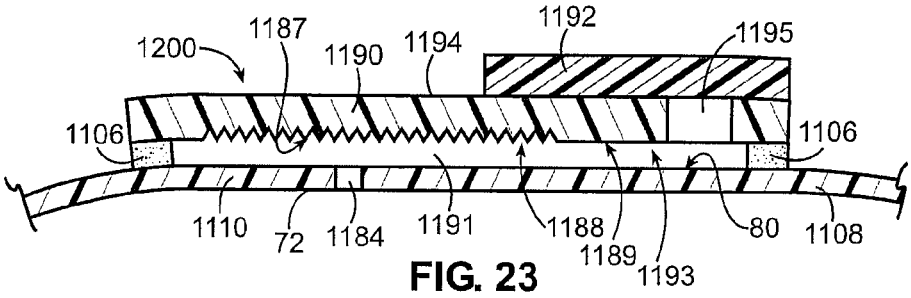
FIG. 23 is a cross-sectional view of another embodiment of an evacuation strip, taken generally along the lines 22-22 of FIG. 21.

Another embodiment of an evacuation strip 1200 is depicted in FIG. 23. The evacuation strip 1200 includes a check valve 1192 attached to an exterior surface 1194 of the strip of material 1190 and in fluid communication with the aperture 1195. This embodiment provides a gastight seal within the check valve 1192 regardless of whether a quality gastight seal is achievable at the sealing region 1193. In this embodiment, the check valve 1192 is illustrated schematically as a simple block of material, but may comprise multiple layers of film as described above, and gas may be evacuated from the container 1108 by placing an evacuation device over the check valve 1192. The second adhesive layer 1197, not shown in FIG. 23, but described with regard to FIG. 22, may also be added to this embodiment at the sealing region 1193.

Figure 24A:
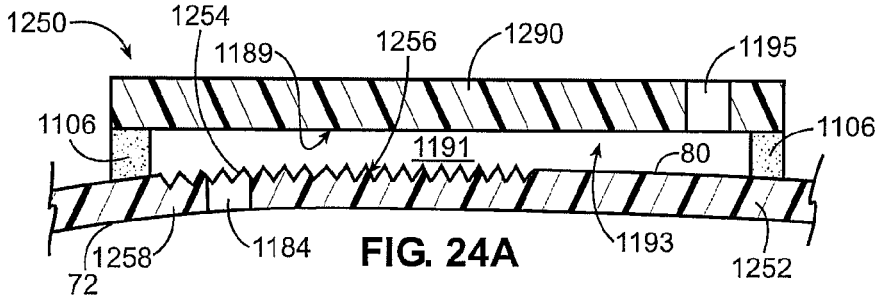
FIG. 24A is a cross-sectional view of a further embodiment of an evacuation strip that is similar to the evacuation strip of FIG. 23, taken generally along the lines 22-22 of FIG. 21.

In another embodiment, as shown in FIG. 24A, an evacuation strip 1250 including a strip of material 1290 may be applied over the surface 80 of a container 1252 that includes a texture or embossment 1254. The container 1252 may be, for example, similar to either of the embodiments of the containers described with regard to FIGS. 1 and 1A hereinabove. Illustratively, the evacuable hard-walled container 50' is depicted in FIG. 1A with the evacuation strip 1250 applied to the exterior surface 80 of the hard sidewall 52'. Referring to FIG. 24A, the interior side 1189 of the strip of material 1290 faces the container 1252 upon application of the evacuation strip 1250 thereto to create the flow channel chamber 1191. The texture 1254 provides flow channels 1256 that may be configured to provide fluid communication between the aperture 1184 disposed through a wall 1258 of the container 1252 and the sealing region 1193. This embodiment allows the wall 1258 to be formed with a geometry, for example, the texture 1254, such that the wall 1258 may function as a part of a valve for evacuating the container 1252. The wall 1258 may be formed, for example, by injection molding, or another process known to one having skill in the art. The strip of material 1290 may flexibly collapse against the container 1252 when a vacuum is drawn on the container 1252 to form a gastight seal between the surface 80 and the interior side 1189 of the strip of material 1290 in the sealing region 1193. Further vacuum may be drawn on the container 1252 by an evacuation device (not shown) placed over the aperture 1195 and a portion of the flow channels 1256 that are in fluid communication with the aperture 1184.

Figure 24B:
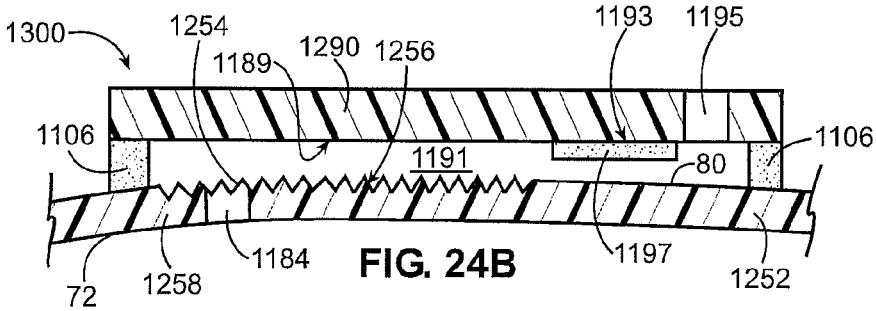
FIG. 24B is a cross-sectional view of another embodiment of an evacuation strip that is similar to the evacuation strip of FIG. 24A, taken generally along the lines 22-22 of FIG. 21.
Figure 24C:
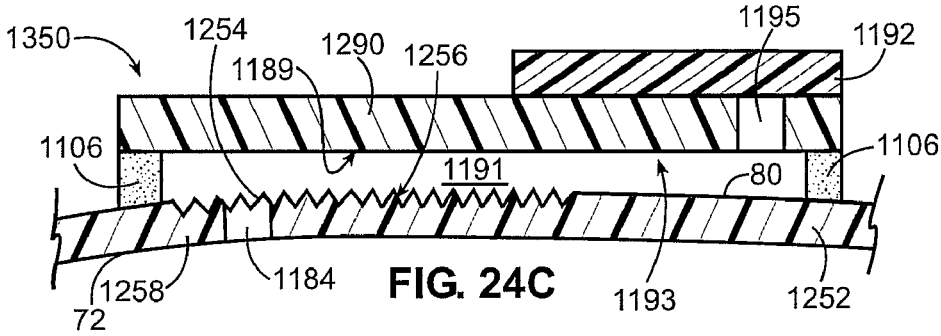
FIG. 24C is a cross-sectional view of yet another embodiment of an evacuation strip that is similar to the evacuation strip of FIG. 24B, taken generally along the lines 22-22 of FIG. 21.
Figure 24D:
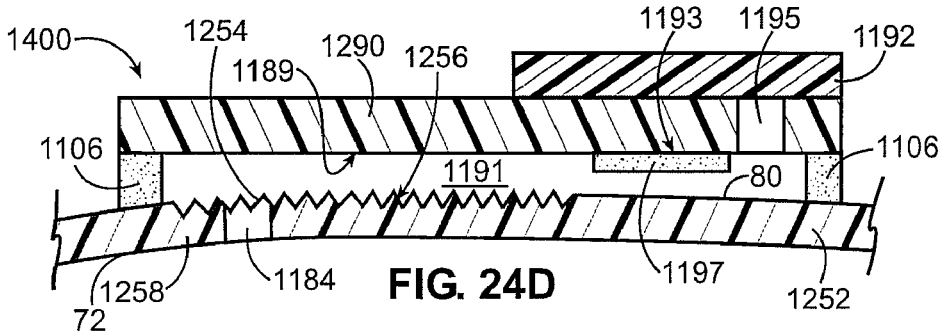
FIG. 24D is a cross-sectional view of a still further embodiment of an evacuation strip that is similar to the evacuation strip of FIG. 24C, taken generally along the lines 22-22 of FIG. 21.

In instances where the surface 80 of the container 1252 is textured or otherwise does not facilitate formation of a seal when in contact with the sealing region 1193, the evacuation strip 1250 may be further modified to accommodate the surface 80. For example, another embodiment of an evacuation strip 1300 may include the second adhesive layer 1197, as shown in FIG. 24B and described hereinabove with regard to FIG. 22. A further embodiment of an evacuation strip 1350 may lack the second adhesive layer 1197, but may include the check valve 1192 as shown in FIG. 24C and described above with regard to FIG. 23. Yet another embodiment of an evacuation strip 1400 may include the second adhesive layer 1197 and the check valve 1292, as shown in FIG. 24D.

In the manufacture of an evacuable pouch described herein, for example, in the embodiment of the evacuable pouch 50 shown in FIG. 1, the first and second sidewalls 52, 54 may be extruded as a single flat sheet that is folded over onto itself to form the bottom peripheral edge 58 for the evacuable pouch 50. The closure mechanism 70, for example, may be extruded as a tape, independently from the first and second sidewalls 52, 54. Any of the embodiments of an evacuable pouch, for example, the evacuable pouch 50 described herein, can be made by various techniques known to those skilled in the art including those described in, for example, Geiger et al., U.S. Pat. No. 4,755,248. Other useful techniques to make an evacuable pouch include those described in, for example, Zieke et al., U.S. Pat. No. 4,741,789. Additional techniques to make an evacuable pouch include those described in, for example, Porchia et al., U.S. Pat. No. 5,012,561. Additional examples of making an evacuable pouch as described herein include, for example, a cast post applied process, a cast integral process, and/or a blown process.

It is contemplated that any of the embodiments of an evacuable pouch or an evacuable hard-walled container that include a check valve as described hereinabove may be provided as a component of a kit or package that comprises a vacuum pump to evacuate gas from the interior of the pouch or container through the check valve. It is further contemplated that any of the embodiments of an evacuation strip as described hereinabove may be provided as a component of a kit or package that comprises a tool, for example, a hole punch, for creating an aperture in a wall of a container, and/or a vacuum pump to evacuate gas from the interior of the container through the aperture via the evacuation strip applied over the aperture.

Although the present disclosure has been described relative to specific exemplary embodiments thereof, it will be understood by those skilled in the art that modifications can be made thereto without departing from the scope and spirit of the disclosure.

INDUSTRIAL APPLICABILITY

The present invention provides an evacuable container that comprises flow channels external to an interior volume of the container. A source of a vacuum may be used with the flow channels to evacuate gas from the container, thereby allowing container contents, such as perishables, to remain fresher for extended periods of time. The flow channels may allow the vacuum source to reach interior regions of the container that are spaced from the vacuum source by facilitating an evacuation path around opposing container walls that may contact one another and form a seal therebetween when the container is subjected to vacuum evacuation.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out the same. The exclusive rights to all modifications that come within the scope of the appended claims are reserved. All patents, patent publications and applications, and other references cited herein are incorporated by reference herein in their entirety.

I claim:

1. An evacuable container comprising:

a first side wall having an interior surface and an exterior surface, the first side wall including an aperture between the interior surface and the exterior surface;

a second side wall having an interior surface and an exterior surface, the second side wall being connected to the first sidewall such that the interior surfaces of the first and second side walls form an interior of the container;

a sheet having a first surface and a second surface, with the first surface facing the exterior surface of the first side wall, and with the sheet being sealingly attached to the exterior surface of the first side wall so as to form a flow chamber between the first side wall and the sheet, the sheet including (i) a plurality of flow channels disposed on the first surface, and (ii) an aperture between the first surface and the second surface; and a check valve disposed in fluid communication with the aperture in the sheet, wherein an evacuation path can be formed from the interior of the container to an exterior of the container through the aperture in the first side wall, the flow chamber, the aperture in the sheet, and the check valve.

2. The evacuable container of claim 1, wherein the check valve includes (i) a first film layer, with an aperture extending through the first film layer, and (ii) a second film layer, with an aperture extending through the second film layer, and wherein the evacuation path passes through the apertures in the first and second film layers.

3. The evacuable container of claim 2, wherein the check valve includes a third film layer, with an aperture extending through the third film layer, and wherein the evacuation path passes through the aperture in the third film layer.

4. The evacuable container of claim 1, wherein the check valve is conextensive with the sheet.

5. The evacuable container of claim 1, further comprising a panel positioned in the flow chamber between the first sidewall and the sheet, with an aperture formed through the panel, wherein the evacuation path passes through the aperture in the panel.

6. The evacuable chamber of claim 5, wherein a plurality of flow channels is formed on the first side wall facing the flow chamber.

7. The evcacuable chamber of claim 1, further comprising a second check valve positioned adjacent to the second side wall.

8. The evacuable chamber of claim 1, wherein the container is provided as a component of a kit that comprises a vacuum pump to evacuate gas from the interior of the container through the check valve.

9. An evacuable container comprising:

a plurality of walls forming an interior of the container, the walls having interior surfaces and exterior surfaces, with one of the walls having an aperture between an interior surface of the wall and an exterior surface of the wall;

a sheet having a first surface and a second surface, with the first surface facing the wall with the aperture, and with the sheet being sealingly attached to the exterior surface of the wall so as to form a flow chamber between the wall and the sheet, the sheet including (i) a plurality of flow channels disposed on the first surface, and (ii) an aperture between the first surface and the second surface; and a check valve disposed in fluid communication with the aperture in the sheet, wherein an evacuation path can be formed from the interior of the container to an exterior of the container through the aperture in the wall, the flow chamber, the aperture in the sheet, and the check valve.

10. An evacuable container according to claim 9, wherein the plurality of walls includes a first side wall having an interior surface and an exterior surface, and a second side wall having an interior surface and an exterior surface, and wherein the first side wall is connected to the second sidewall such that the interior surfaces of the first and second side walls form the interior of the container.

11. An evacubale container according to claim 9, wherein the plurality of walls define a flexible pouch or a hard-walled container.

12. An evacuable container according to claim 9, wherein the container is provided as a component of a kit that comprises a vacuum pump to evacuate gas from the interior of the container through the check valve.

* * * * *